United States Patent [19]

Konishi

[11] Patent Number: 4,983,940

[45] Date of Patent: Jan. 8, 1991

[54] ELECTROMAGNETIC SWITCH

[75] Inventor: Keiichi Konishi, Himeji, Japan

[73] Assignee: Mitsubishi Denki Kabushiki Kaisha, Tokyo, Japan

[21] Appl. No.: 494,346

[22] Filed: Mar. 16, 1990

[30] Foreign Application Priority Data

Apr. 13, 1989 [JP] Japan ..... 1-93719

[51] Int. Cl.[5] ..... H01H 67/02

[52] U.S. Cl. ..... 335/126; 335/131

[58] Field of Search ..... 335/126, 131; 310/83; 74/7 E, 7 A

[56] References Cited

U.S. PATENT DOCUMENTS 4,800,766 7/1984 Isozumi .
4,852,417 8/1989 Tanaka ..... 335/131
4,890,085 12/1989 Saito et al. ..... 336/83

FOREIGN PATENT DOCUMENTS 105461 1/1989 Japan .

*Primary Examiner*—Leo P. Picard
*Assistant Examiner*—Lincoln Donovan
*Attorney, Agent, or Firm*—Sughrue, Mion, Zinn, Macpeak and Seas

[57] ABSTRACT

An electromagnetic switch comprises an outer casing, a cylindrical bobbin which is arranged in the outer casing, which has a magnetic core and which has an exciting coil wound thereon, a plunger arranged in an inner passage of the bobbin so as to be slidable under the action of magnetic attraction force, a rod which moves associating with the plunger, a movable contact which is carried on the rod, and which gets in contact with a fixed contact when the plunger moves in one direction, the fixed contact being arranged at a predetermined position, a cutout formed in an outer peripheral portion of the core, a channel-like lead-out portion which is formed to project from one end of the bobbin in the axial direction, which is fit in the cutout, and which is open in a radial direction outwardly, a mounting opening formed in the outer casing to confront to the cutout, and a terminal member which is press-fit into the mounting opening and which includes a terminal plate connected in the lead-out portion to one of the opposite leads of the exciting coil.

19 Claims, 5 Drawing Sheets

ELECTROMAGNETIC SWITCH

BACKGROUND OF THE INVENTION

1. Field of the Invention

The present invention relates to an electromagnetic switch and is more particularly concerned with an electromagnetic switch which is particularly suited for use in a coaxial type starter for starting the engine of a vehicle.

2. Discussion of Background

A coaxial type starter for starting an engine has been constructed as disclosed in Japanese Unexamined Utility Model Publication No. 105461/1988. The structure of the electromagnetic switch in such conventional coaxial type starter will be explained with reference to FIGS. 6 and 7.

The coaxial type starter includes a d.c. motor 1 having an output rotary shaft 2, and an electromagnetic switch 3. The electromagnetic switch 3 can be arranged at the rear end of the d.c. motor 1 to slide the output rotary shaft 2, and to supply power from a battery to the d.c. motor 1 when the key switch (not shown) of the vehicle is closed. The electromagnetic switch 3 is mainly constituted by a casing 4, a forward and a backward core **5*a* and 5*b* forming a magnetic path together with the casing 4, a plastic bobbin 6 supported by the cores, an exciting coil 7 wound on the bobbin 6, and a plastic cylindrical plunger 8 slidably arranged in the inner passage of the bobbin 6**.

The cylindrical plunger 8 has its inner side integrally provided with an inner plate **8*a*. The inner plate 8*a* has its central portion connected to one end of a plunger rod 9. The plunger rod 9 has its other end inserted from the rear end of the d.c. motor 1 into a hollow armature rotary shaft of the d.c. motor 1. The plunger rod 9 works to transmit the shifting force of the plunger 8 to the output rotary shaft 2 through a spring 10 which is arranged in the bore of the output rotary shaft 2. The plunger rod 9 has a sleeve 11 mounted thereon at the side where the plunger rod 9 is connected to the inner plate 8*a* of the plunger 8. On the sleeve 11, a movable contact 13 is slidably carried through an insulating member 12**.

In such electromagnetic switch 3, the connecting terminal portion (switch terminal) of the exciting coil 7 to the key switch in general has such structure that a rear bracket 14 of the starter is provided with a cutout at the side facing the electromagnetic switch to position at the front side, i.e., the d.c. motor side of the forward core **5*a* a terminal molded member 16 prepared by molding a terminal plate 15 as shown in FIG. 7. The terminal molded member 16 is fitted into the cutout, the inner end of the terminal plate 15 is connected to one of the opposite leads of the exciting coil 7 led out forwardly through e.g. an opening formed in the forward core 5*a*, and the outer end 15*a* of the terminal plate 15** is connected to leads from the key switch.

The conventional switch terminal structure as stated earlier has a problem wherein the entire axial length of the electromagnetic switch is great because the terminal molded member 16 is arranged closer to the d.c. motor 1 than the forward core **5*a*** in terms of space.

SUMMARY OF THE INVENTION

It is an object of the present invention to eliminate the disadvantage of the conventional electromagnetic switch and to provide an electromagnetic switch which can shorten the entire length in the axial direction to make the size compact.

The foregoing and other objects of the present invention have been attained by providing an electric magnetic switch comprising an outer casing, a cylindrical bobbin which is arranged in the outer casing, which has a magnetic core and which has an exciting coil wound thereon, a plunger arranged in an inner passage of the bobbin so as to be slidable under the action of magnetic attraction force, a rod which moves associating with the plunger, a movable contact which is carried on the rod, and which gets in contact with a fixed contact when the plunger moves in one direction, the fixed contact being arranged at a predetermined position, a cutout formed in an outer peripheral portion of the core, a channel-like lead-out portion which is formed to project from one end of the bobbin in the axial direction, which is fit in the cutout, and which is open in a radial direction outwardly, a mounting opening formed in the outer casing to confront to the cutout, and a terminal member which is press-fit into the mounting opening and which includes a terminal plate connected in the lead-out portion to a lead of the exciting coil.

In accordance with the electromagnetic switch of the present invention, the engagement of the lead-out portion of the bobbin with the cutout of the core is done simultaneously when the core is located at a predetermined position. The terminal member with the terminal plate is mounted, by e.g. press-fit, into the mounting opening which is formed in the outer casing. The exciting coil has its lead connected to the terminal plate which is arranged in the lead-out portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The electromagnetic switch according to the present invention will be described in detail with reference to an preferred embodiment illustrated in the accompanying drawings.

Figure 1:
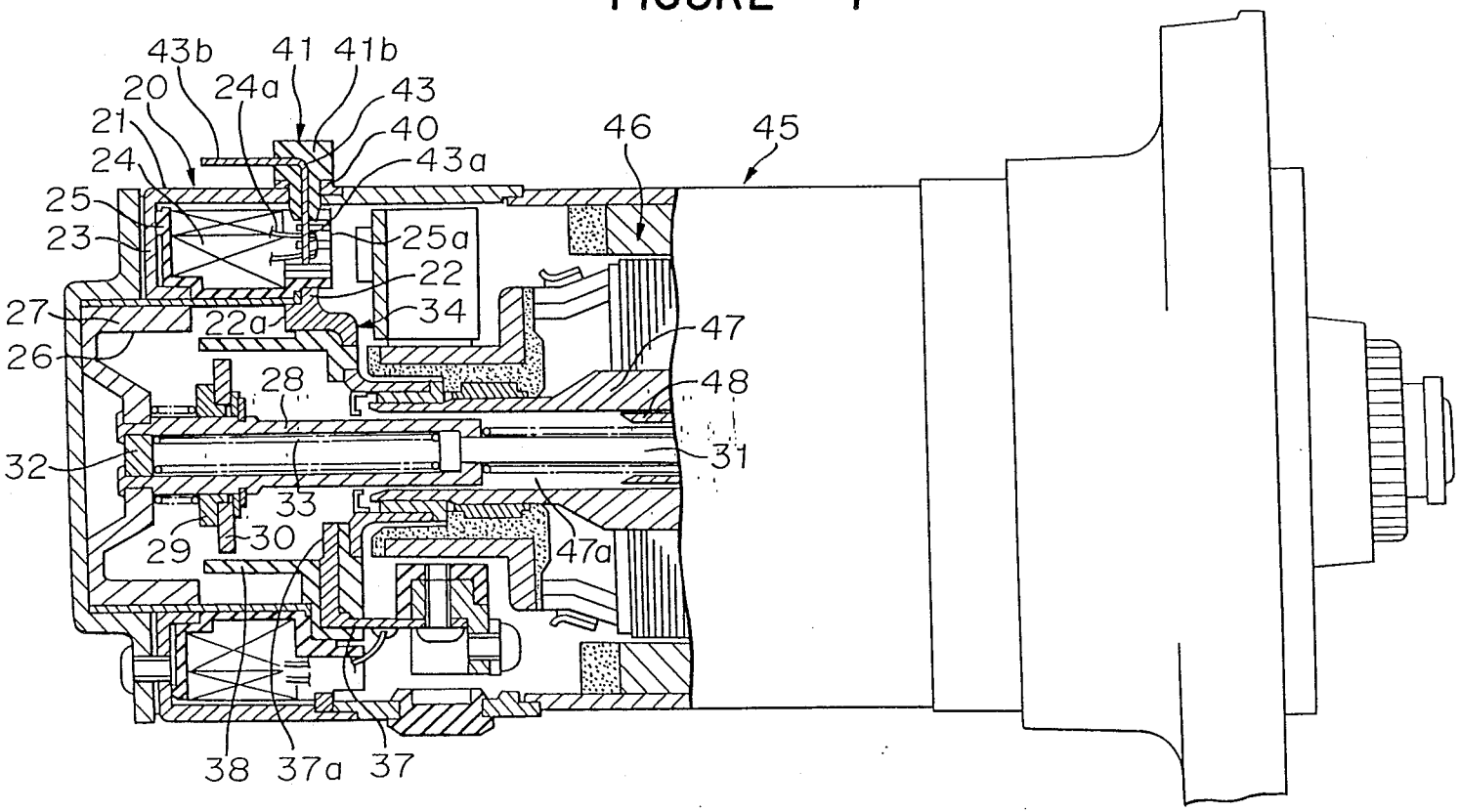
FIG. 1 is a side view partly in section of an axial type starter with an embodiment of the electromagnetic switch according to the present invention applied, and is taken along the line I—I of FIG. 2.

In FIG. 1, there is shown a coaxial type starter 45 which is constructed by use of the electromagnetic switch 20 according to an embodiment of the present invention.

The electromagnetic switch 20 of this embodiment includes an outer casing 21, and a forward and a rearward core 22 and 23 forming a magnetic path together with the outer casing 21. Between the cores 22 and 23, there is arranged a plastic bobbin 25 which has its circumferential surface formed with a groove to wind an exciting coil 24 therein. The bobbin has a central opening in the axial direction, in which a sleeve 26 is fit. Inside the sleeve 26, there are provided a plunger 27 which has a U-shaped section in the axial direction and is slidable in the central opening in the axial direction, a tubular rod 28 which is made of non-magnetic stainless steel, and which has one end connected to the plunger 27 and the other end inserted from the rear end of an armature rotary shaft 47 of a d.c. motor 46 into a bore 47*a* formed in the rotary shaft 47 in the axial direction, and a movable contact 30 carried on the rod 28 through an insulating member 29. In the tubular rod 28 is fit a push rod 31 to be slidable therein. The push rod 31 extends forwardly from the front opening of the tubular rod 28. The front end of the push rod 31 confronts, with a small gap, a steel ball (not shown) which is arranged in a recessed portion formed in the rear end of an output rotary shaft 48.

The tubular rod 28 has its rear end closed. Inside the rod 28 is arranged a coiled spring 33 which has its opposed ends in touch with the closed portion 32 of the rear end and the inner end surface of the push rod 31. As the tubular rod 28 moves, the coiled spring 33 pushes the push rod 31 to apply pushing force to the output rotary shaft 48.

Figure 2:
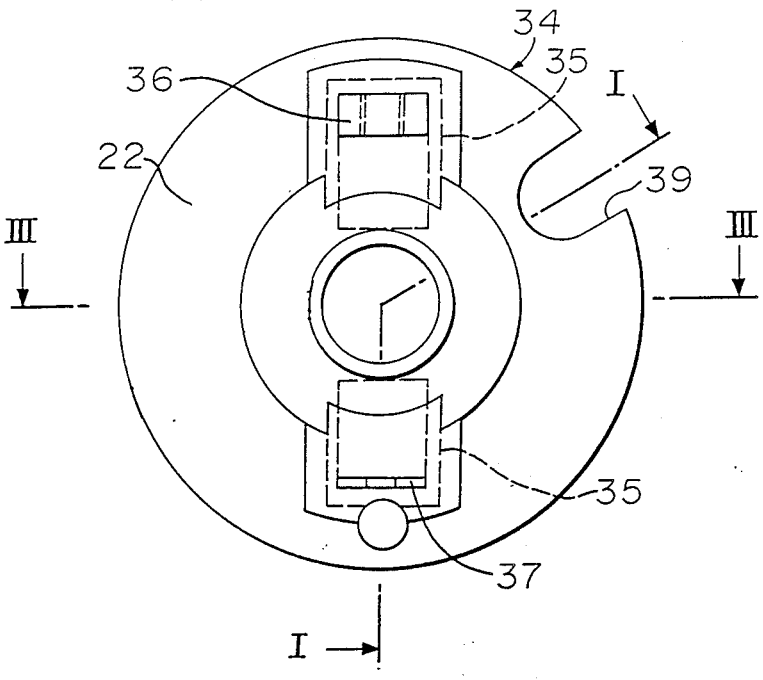
FIG. 2 is a front view of a unit assembly of a forward core and a connecting terminal, the core being a part of the electromagnetic switch.
Figure 3:
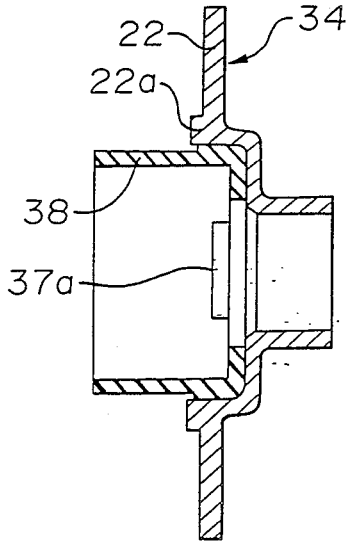
FIG. 3 is a cross sectional view of the unit assembly taken along the line III—III of FIG. 2.

The forward core 22 which forms a part of the electromagnetic switch 20 is in the form of a disk and has a one-unit structure as a core and connecting terminal assemblage 34 including a fixed contact and the like. The core and connecting terminal assemblage (hereinbelow, referred to as the assemblage) 34 is constructed in such manner that as shown in FIGS. 2 and 3 the disk-shaped core 22 forms the main body, two windows 35 are formed in the main body to symmetrically lie in a diametrical direction, and connecting terminal plates 36 and 37 are incorporated into the core 22 by use of the windows 35 and are molded in resin for fixing. When the connecting terminal plates are molded with resin, a cylindrical portion 38 which surrounds the movable contact 30, and other portions are simultaneously formed by this molding. In FIG. 3, reference numeral 22*a* designates a magnetic attraction force generating portion which is formed on the core 22 to face the front end surface of the plunger 27. In FIGS. 1 and 3, reference numeral 37*a* designates a fixed contact which is formed on one of the connecting terminal plates 37.

Figure 5:
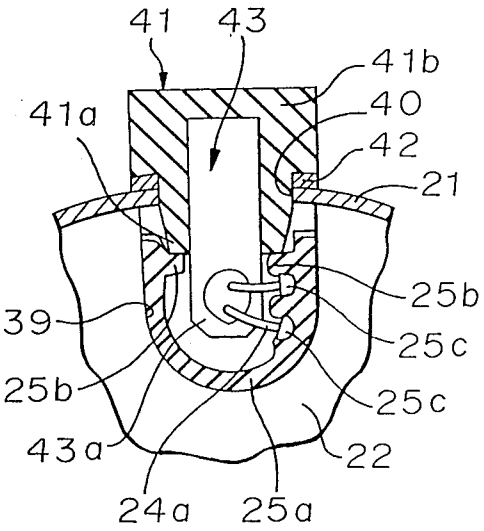
FIG. 5 is a fragmentary cross sectional view of the terminal portion taken along the line V—V of FIG. 4.
Figure 4:
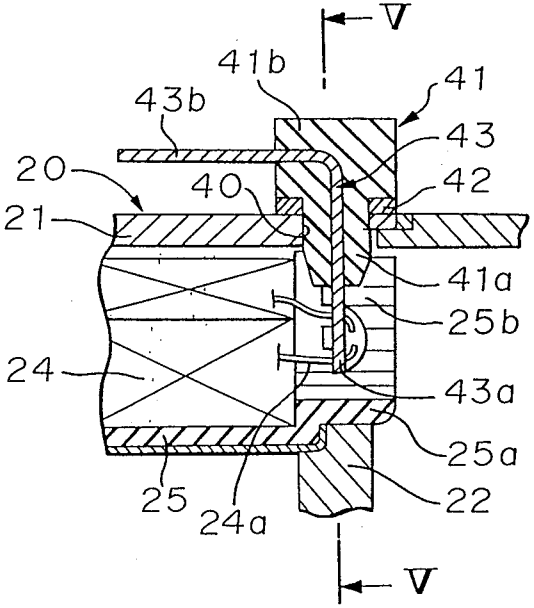
FIG. 4 is a fragmentary sectional view showing in detail the terminal portion of an exciting switch in the electromagnetic switch of the coaxial type starter shown in FIG. 1.
Figure 6:
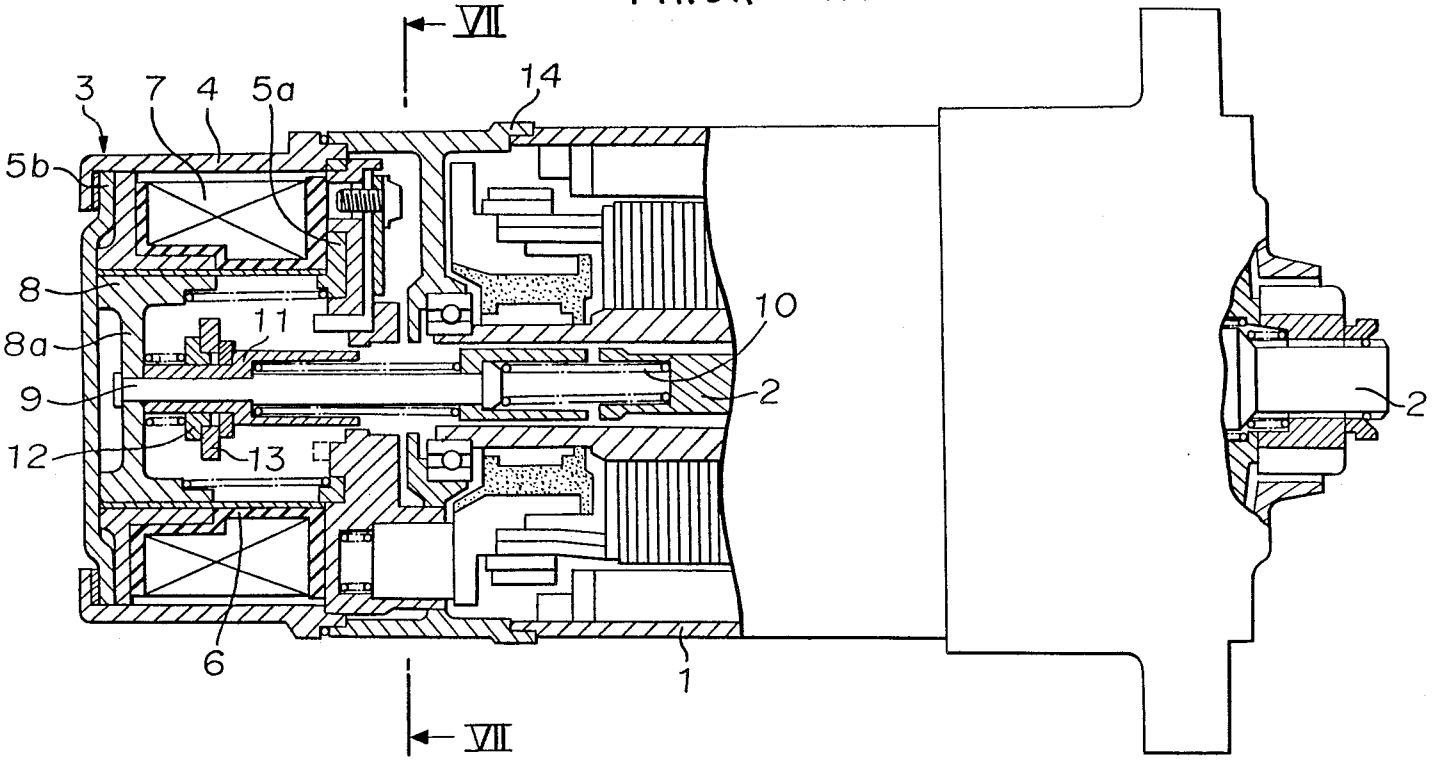
FIGURE 6 PRIOR ART
FIG. 6 is a side view partly in section showing a conventional axial type starter.
Figure 7:
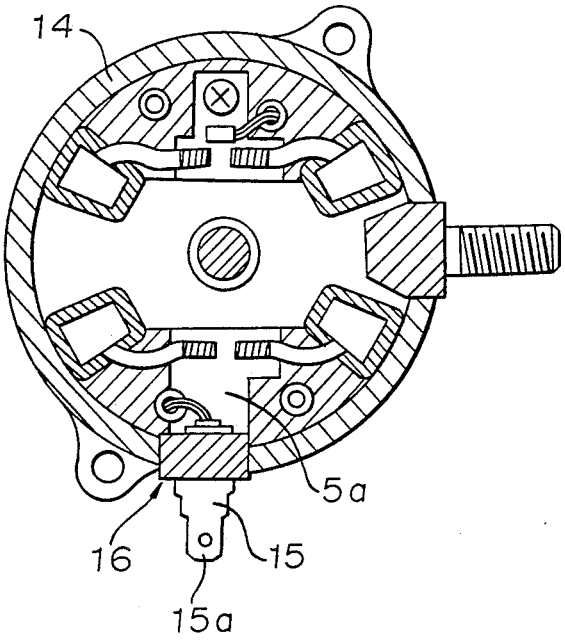
FIGURE 7 PRIOR ART
FIG. 7 is a cross sectional view of the conventional coaxial type starter taken along the line VII—VII of FIG. 6.

The core 22 of such assemblage 34 is provided at its outer peripheral portion with a U-shaped cutout 39 as shown in FIG. 2. From the front end wall of the bobbin 25 at a position which corresponds to the cutout 39 of the core 22 when the assemblage 34 is located at a predetermined position as a component part of the coaxial type starter 45, a channel-like lead-out portion 25*a* which is open in a radial direction outwardly projects in the axial direction by a length which is substantially equal to the thickness of the core 22, the lead-out portion 25*a* being an integral part of the end wall of the bobbin. The lead-out portion 25*a* is fit into the cutout 39 of the core 22 from the axial direction as shown in FIGS. 4 and 5, and has a U-shaped cross-section.

In the outer casing 21 of the electromagnetic switch 20 a mounting opening 40 is formed at a position which corresponds to the cutout 39 of the core 22. As shown in FIG. 4, in the mounting opening 40 is press-fit a terminal member 41 which comprises an inserted portion 41*a* and a head portion 41*b* formed on the outer end of the inserted portion to have a size greater than that of the inserted portion, waterproof packing 42 being arranged around the inserted portion 41*a*. In the terminal member 41 is embedded an L-shaped terminal plate 43. The terminal plate 43 has one end 43*a* passing through the central portion of the inserted portion 41*a* and inserted from the opened portion of the lead-out portion 25*a* into the channel in it. To the end 43*a* is connected one of the opposite leads 24*a* of each exciting coil 4. The electrical connection of the other lead of each exciting coil is done like the conventional electromagnetic switch. The terminal plate 43 has the other end 43*b* projecting from a lateral surface of the head portion 41*b* and connected to a lead from the key switch. The lead-out portion 25*a* which is formed to project from the bobbin 25 in the axial direction has steps 25*b* arranged on the opposing surfaces of the channel, the steps 25*b* functioning to receive the bottom surface of the inserted portion 41*a* in order to locate the end 43*a* of the terminal plate 43 in place. In addition, guide grooves 25*c* are formed in the inner wall surface forming the channel of the lead-out portion 25. This is because the leads 24*a* have to be taken out along a lateral portion of the one end of the terminal plate in order to connect the leads 24*a* to the end 43*a* of the terminal plate 43 by soldering after having assembled the assemblage 34 to the electromagnetic switch by mounting the assemblage 34 into the mounting opening 40 of the outer casing 21.

In the electromagnetic switch 20 of the embodiment, the core and contact terminal assemblage 34 is assembled at a predetermined position as a component part of the electromagnetic switch, the terminal member 41 is fit into the mounting opening 40 of the outer casing, and the leads 24*a* are connected to the terminal plate 43. As a result, the terminal member 41 is located substantially in the plane in a radial direction, where the core 22 lies, eliminating the provision of a space for the terminal member 41 in the axial direction. This arrangement can shorten the entire axial length of the electromagnetic switch, and consequently the entire axial length of the starter using the electromagnetic switch.

Obviously, numerous modifications and variations of the present invention are possible in light of the above teachings. It is therefore to be understood that within the scope of the appended claims, the invention may be practiced otherwise than as specifically described herein.

What is claimed is:

1. An electromagnetic switch, comprising:

(a) an outer casing (21), (b) a cylindrical bobbin (25) arranged in the outer casing proximate magnetic core means (22,23) and having an exciting coil (24) wound thereon, (c) a plunger (27) arranged in an inner passage of the bobbin so as to be slidable under the action of magnetic attraction force, (d) a rod (28) disposed to move in association with the plunger, (e) a movable contact (30) carried on the rod, and adapted to engage a fixed contact (37*a*) when the plunger moves in one direction, the fixed contact being arranged at a predetermined position, (f) a U-shaped cutout (39) formed in an outer peripheral edge of the magnetic core means, (g) a U-shaped lead-out member (25*a*) projecting from one end of the bobbin in an axial direction, disposed in the cutout, and open in a radially outward direction, (h) a mounting opening (40) formed in the outer casing and confronting the cutout, and (i) an electrical terminal member (41) press-fitted into the mounting opening, and including an electrical terminal plate (43) extending radially inwardly through the mounting opening and into the lead-out member, and connected thereat to leads (24*a*) of the exciting coil.

2. An electromagnetic switch according to claim 1, wherein the rod is tubular, and extends into a bore (47*a*) formed in an armature rotary shaft (47) of an electric motor to which the switch is attached.

3. An electromagnetic switch according to claim 2, wherein the tubular rod has a push rod (31) slidably arranged therein.

4. An electromagnetic switch according to claim 3, wherein the push rod extends forwardly from a front end opening of the tubular rod.

5. An electromagnetic switch according to claim 3, wherein a rear end of the tubular rod is closed, and a coiled spring is disposed between said closed end and an inner end of the push rod.

6. An electromagnetic switch according to claim 1, wherein the magnetic core means comprises a forward core member (22) and a rearward core member (23).

7. An electromagnetic switch according to claim 6, wherein the forward core member is in the form of a disk.

8. An electromagnetic switch according to claim 7, wherein the forward core member has a one-piece construction including the fixed contact.

9. An electromagnetic switch according to claim 6, wherein the forward core member is provided with at least one window (35) in a radial direction.

10. An electromagnetic switch according to claim 9, wherein the forward core member has a further terminal plate (37) disposed in the window.

11. An electromagnetic switch according to claim 10, wherein the further terminal plate is fixed in place by molded resin.

12. An electromagnetic switch according to claim 11, wherein a cylindrical portion (38) surrounding the movable contact is formed by molded resin at the same time the further terminal plate is fixed.

13. An electromagnetic switch according to claim 1, wherein the terminal member comprises an inserted portion (41*a*), and a head portion (41*b*) formed on an outer end of the inserted portion and having a size greater than that of the inserted portion.

14. An electromagnetic switch according to claim 13, wherein the inserted portilon has waterproof packing arranged therearound.

15. An electromagnetic switch according to claim 13, wherein the electrical terminal plate is L-shaped in section, and is embedded in the terminal member.

16. An electromagnetic switch according to claim 15, wherein the electrical terminal plate has one end passing through the inserted portion and terminating in the lead-out member.

17. An electromagnetic switch according to claim 16, wherein another opposite end of the electrical terminal plate is adapted to be connected to a lead from a key switch for the electromagnetic switch.

18. An electromagnetic switch according to claim 13, wherein the lead-out member has at least one step (25*b*) formed on an inner surface to receive a bottom of the inserted portion.

19. An electromagnetic switch according to claim 17, wherein the lead-out member has at least one guide groove (25*c*) formed in an inner wall to accommodate a lead of the exciting coil.

* * * * *